US005455380A

United States Patent [19]

Matsuda et al.

[11] Patent Number: 5,455,380

[45] Date of Patent: Oct. 3, 1995

[54] ELECTRONIC MUSICAL INSTRUMENT ALTERING TONE SOUND EFFECTS RESPONSIVE TO NUMBER OF CHANNELS OR TONE RANGE

[75] Inventors: Eiji Matsuda; Gen Izumisawa, both of Shizuoka, Japan

[73] Assignee: Kabushiki Kaisha Kawai Gakki Seisakusho, Japan

[21] Appl. No.: 165,253

[22] Filed: Dec. 10, 1993

[30] Foreign Application Priority Data

| | | | |
|---|---|---|---|
| Feb. 18, 1993 | [JP] | Japan | 5-051240 |
| Feb. 18, 1993 | [JP] | Japan | 5-051242 |
| Feb. 23, 1993 | [JP] | Japan | 5-056334 |

[51] Int. Cl.[6] ..... G10H 1/053; G10H 1/46

[52] U.S. Cl. ..... 84/662; 84/665; 84/707; 84/711; 84/DIG. 26

[58] Field of Search ..... 84/626–633, 662–665, 84/701–711, 737–741, DIG. 4, DIG. 5, DIG. 26, DIG. 27

[56] References Cited

U.S. PATENT DOCUMENTS 5,278,349 1/1994 Mutah et al. ..... 84/664 X

*Primary Examiner*—Stanley J. Witkowski

*Attorney, Agent, or Firm*—Andrus, Sceales, Starke & Sawall

[57] ABSTRACT

An electronic musical instrument changes sound effects, such as resonance and reverberation, during a performance. The instrument has a tone-ON channel counter, for counting keys that are simultaneously depressed; an output channel determination unit, for determining an output channel in consonance with a count value held by the tone-ON channel counter; and an output channel selector, for designating the output channel, so as to provide a desired sound effect through the selected output channel.

In a modification, the instrument has a parameter value determination unit, for determining a parameter value in consonance with a count value counted by the tone-ON channel counter; a resonant tone production unit, for adding a desired sound effect; and a controller, for employing the parameter value to control the resonant tone production unit.

In a further modification, the instrument has an effect addition unit, for adding sound effects in consonance with a parameter value designated by the parameter value determination unit and the resonant tone production unit.

11 Claims, 18 Drawing Sheets

ELECTRONIC MUSICAL INSTRUMENT ALTERING TONE SOUND EFFECTS RESPONSIVE TO NUMBER OF CHANNELS OR TONE RANGE

BACKGROUND OF THE INVENTION

1. Field of the Invention

The present invention relates to an electronic musical instrument, such as a synthesizer, an electronic piano, an electronic organ, a single keyboard, and a tone production module, and in particular to an electronic musical instrument that can alter sound effects in consonance with the number of note-on channels and the tone range.

2. Description of the Related Art

On a piano, dampers ordinarily rest on the strings, and when a key is depressed, to permit a musical tone to be produced a damper is lifted from the strings that correspond to the depressed key. When many keys are depressed simultaneously during a live performance, the strings from which dampers are lifted produce a resonant effect. Therefore, during a live performance the resonant effects produced by piano strings differ depending on the number of keys that are depressed, and the tone range of the keys, and musical tones that are emitted vary slightly.

A conventional electronic musical instrument has a resonance circuit such as is shown in FIG. 18, and employs the circuit to effect changes in musical tones. Since the electronic musical instrument includes only one resonance circuit and reverberation and resonance effects are selected by manipulating switches, etc. on a panel, only a constant tone wave change can be generated during a performance, regardless of the number of depressed keys and the tone range of the keys.

Since except for effect addition means the basic arrangement of the conventional electronic musical instrument depicted in FIG. 18 is the same as that of an electronic musical instrument of the present invention that is shown in FIG. 4, the structures and the functions of its individual sections will not be explained here, but will be explained in detail later, while referring to FIG. 4.

As described above, since sound effects, such as resonance and reverberation, are selected in advance by manipulating switches, etc. on a panel of a conventional electronic musical instrument, delicate changes in musical tones, which are effected by changing the number of depressed keys or by depressing different keys, cannot be generated, and an improved sound effect production function is required.

SUMMARY OF THE INVENTION

To overcome such a shortcoming, it is therefore an object of the present invention to provide an electronic musical instrument that during a performance counts the key-ON states (note-ON states) effected via a keyboard, and employs the obtained count to control resonant effect means that alters such sound effects as resonance and reverberation.

To achieve the above described object, an electronic musical instrument according to the first invention comprises: tone channel count means, for counting output channels in a note-ON state; output channel determination means, for designating one of the output channels in consonance with a count value acquired by the tone channel count means; and output channel selection means, for selecting the output channel that is designated by the output channel determination means; and a plurality of the output channels, one of which is selected by the output channel selection means for the production of a desired sound effect.

The tone channel count means of the electronic musical instrument is provided to count the keys that are depressed on a keyboard.

With the above described arrangement, during a performance an electronic musical instrument of the first invention switches resonance circuits to add sound effects, such as resonance and reverberation, in consonance with the number of keys that are simultaneously depressed and outputs an effect-added musical tone.

Since even during a performance delicate tone changes can be expressed in consonance with the number of depressed keys, music produced by such an electronic musical instrument sounds similar to that produced by an acoustic musical instrument.

To achieve the aforementioned object, an electronic musical instrument according to the second invention comprises: tone channel count means, for counting tone channels that are simultaneously set to a note-ON state; resonant tone production means, for adding desired sound effects; parameter value determination means, for determining a parameter value to control the resonant tone production means in consonance with a count value acquired by the tone channel count means; and control means, for controlling the resonant tone production means in consonance with the parameter value that is designated by the parameter value determination means.

According to an electronic musical instrument of the second invention, the tone channel count means is provided to count the keys that are depressed on the keyboard.

With such an arrangement, to add resonance, reverberation or other sound effects to a musical tone in consonance with the number of keys that are simultaneously depressed or the number of musical tones that are simultaneously produced, the second invention switches control parameter values that are employed to control the resonant tone production means, and can thus vary the intensity of sound effects even during a performance.

In this manner, during a performance an electronic musical instrument that has even one resonant tone production means can automatically amplify a tone signal in consonance with a count value, change the volume of a musical tone, extend or shorten reverberation, and vary acoustic effects. The expression of delicate tone changes is therefore ensured, and the music that is generated resembles closely the music that is produced by an acoustic musical instrument.

To achieve the previously described object, an electronic musical instrument according to the third invention comprises: tone channel count means, for counting tone channels that are simultaneously set to a note-ON state; parameter value determination means, for determining a parameter value in consonance with a count value acquired by the tone channel count means; effect addition means, for adding sound effects in consonance with the parameter value that is designated by the parameter value determination means; and resonant tone production means, for adding desired sound effects.

With such an arrangement, the third invention, in consonance with the number of note-ON channels, determines a parameter value, controls the effect addition means by employing the parameter value to change the volume of a tone signal, and sends the result to the resonant tone production means. In this manner, various sound effects, such as resonance and reverberation, can be generated during a performance, and the intensity of the sound effects can be altered.

During a performance, an electronic musical instrument that has even one resonant tone production means can automatically amplify a tone signal in consonance with a count value, change the volume of a musical tone, extend or shorten reverberation, and vary acoustic effects. The expression of delicate tone changes is therefore ensured, and the music that is generated resembles closely the music that is produced by an acoustic musical instrument.

DETAILED DESCRIPTION OF THE PREFERRED EMBODIMENTS

Figure 4:
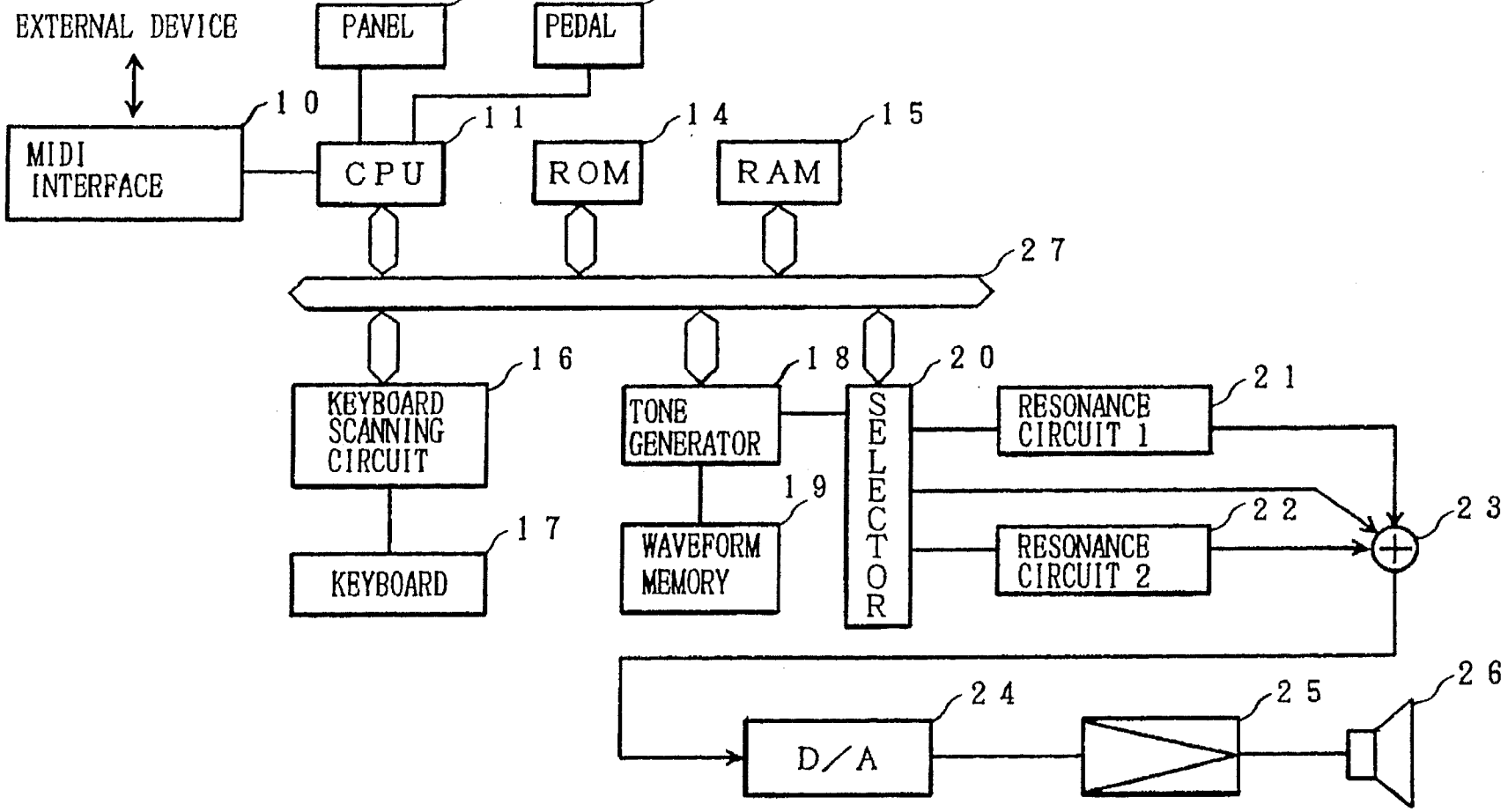
FIG. 4 is a diagram illustrating the general arrangement of an electronic musical instrument according to the first invention.

FIG. 4 is a schematic block diagram illustrating the general structure of an electronic musical instrument, according to the first invention, that has multiple resonance circuits.

An MIDI interface 10 is employed for the exchange of play data by an external device (not shown) and a CPU 11. The external device either supplies play data to the electronic musical instrument or receives play data, for the production of musical tones, from the electronic musical instrument. An electronic musical instrument that has an MIDI interface, such as an electronic piano, an electronic organ, or an electronic keyboard, is employed as such an external device. The MIDI interface 10 is connected to the CPU 11 directly, not via a system bus 27.

The CPU 11 executes a control program that is stored in a program memory section of a ROM 14 to control the individual sections of the electronic musical instrument. Also, in conjunction with a selector 20 the CPU 11 employs a resonance circuit selection table, which is provided in the ROM 14, to perform a circuit selection function. The resonance circuit selection table is related to the present invention.

The ROM 14, a RAM 15, a keyboard scanning circuit 16, a tone generator 18, and the selector 20 are all connected to the CPU 11 via the system bus 27.

On a panel section 12 are provided various switches, such as a power switch, a mode select switch, a melody select switch, and a rhythm select switch. The switch set/reset states are scanned by an internally provided panel scanning circuit. The states of the switches that are scanned by the panel scanning circuit of the panel section 12 are stored in the RAM 15 under the control of the CPU 11.

A display device (not shown) that displays various information entries is also provided on the panel section 12. Further, a timbre select switch and a sound effect select switch, for such effects as reverberation and chorus and which is related to the present invention, are also provided on the panel section 12.

The number of pedals 13 that are provided varies in accordance with the type of electronic musical instrument, and may include, for example, a damper pedal, a soft pedal, and a loud pedal. For the pedals 13 the CPU 11 controls variable resistors, which have sliders that are displaced in consonance with the distance the pedals are depressed, to obtain specific voltages for the alteration of volume and attenuation characteristics.

In the ROM 14 are stored not only the above described program that the CPU 11 executes, but also timbre data and various other fixed data. In the timbre data memory in the ROM 14 are stored data for generating a tone signal, such as a frequency number, a waveform number, an envelope waveform number, and mode data, and various other fixed data.

Data stored in the timbre data memory are pointed to by a timbre pointer. More specifically, the timber pointer is altered by manipulating the panel switches or the keyboard 17, and data that are pointed to by the altered timber pointer are read from a waveform memory 19. A predetermined process is then performed on the data, and the resultant data are sent to the tone generator 18.

A table for determining attack speed, an attack level, decay speed and a decay level, and a table for determining an output channel by employing a count value, both of which tables are related to the present invention, are provided in the ROM 14.

In the RAM 15 are defined a work area for the CPU 11, and various registers, counters, and flags for controlling the electronic musical instrument. The RAM 15 also includes a data area to which and wherein required data that are stored in the ROM 14 are transmitted and stored; multiple registers, wherein data necessary for tone release are set in consonance with the key states or the switch states on the panel section 12; an assigner memory, for storing data that are employed for assigning to unused channels tone generating circuits of the tone generator 18; and a storage area, wherein play data is stored.

Data that reflect the states of the switches on the panel section 12, and that are stored in the RAM 15, are referred to by the CPU 11 for tone production, or in other cases as needed.

A key-state map, wherein the key-ON/OFF states of a keyboard 17 are stored, and a note-ON counter are also provided in the RAM 15.

Reading data from or writing data to the RAM 15 is performed via the system bus 27 by the CPU 11.

The keyboard 17 is used to select a musical tone to be produced, and includes multiple keys and key switches that close and open in consonance with key depression and key release. Key depression or key release by a player is detected and sent to the tone generator 18 under the control of the CPU 11.

Play data that are generated by key depression/release at the keyboard 17 are temporarily held in the RAM 15 and read by the CPU 11 as necessary.

The keyboard scanning circuit 16 scans the ON/OFF states of the key switches on the keyboard 17 and sends the states to the CPU 11. To do this, the keyboard scanning circuit 16 transmits a scan signal to the keyboard 17.

In response to the scan signal, the keyboard 17 transmits a signal that indicates the closing/opening of the key switches to the keyboard scanning circuit 16. The ON/OFF state signals for the key switches, which are scanned by the keyboard scanning circuit 16, are transmitted as key codes (key numbers) to the CPU 11 via a touch detector (not shown) and the system bus 27.

The tone generator 18 reads and reproduces tone wave data, which are stored in the waveform memory 19, and generates a tone signal that corresponds to the type of electronic musical instrument. In consonance with control data received from the keyboard 17 and output by the CPU 11, the tone generator 18 reads from the waveform memory 19 tone waveform data and envelope data that correspond to a timbre and a volume that are designated. The tone generator 18 then adds an envelope to the read tone waveform data and transmits the resultant data as a tone signal to the selector 20.

The waveform memory 19, constituted by, for example, a ROM, is used for storing tone waveform data, such as those for soft touch components, heavy touch components and strike components, and envelope data. The waveform memory 19 is accessed by a soft touch component tone signal generating section, a heavy touch component tone signal generating section, and a strike component tone signal generating section (none of which are shown) of the tone generator 18.

The selector 20 receives a control signal from the CPU 11 and selects a resonance circuit to which a tone signal from the tone generator 18 is to be transmitted. The output of the selector 20 is sent to a through circuit or sent to a resonance circuit 21 or 22. A detailed explanation will be given later.

A plurality of the resonance circuits 21 and 22 are provided in, for example, an electronic piano to simulate the conditions required for the production of sound effects such as reverberation and resonance. During a performance, a specific circuit is selected by the selector 20 in consonance with the number of simultaneously depressed keys, and the circuit generates resonance and reverberation that closely resemble those produced by the vibration of strings and a frame.

An adder 23 adds the tone signals that are output by the resonance circuits 21 and 22, etc., and outputs the result.

A D/A converter 24 converts the received digital tone signal into an analog tone signal. The analog tone signal converted by the D/A converter 24 is transmitted to an amplifier 25.

The D/A converter 24 may be located between the selector 20 and the resonance circuits 21 and 22.

The amplifier 25 employs volume data supplied by the CPU 11 to amplify by a predetermined gain the analog tone signal received from the D/A converter 24, and then supplies the resultant signal to a loudspeaker 26.

The loudspeaker 26 converts into an acoustic signal the analog tone signal that is sent as an electric signal from the amplifier 25 and releases a musical tone.

The CPU 11, the ROM 14, the RAM 15, the keyboard scanning circuit 16, the tone generator 18, and the selector 20 are mutually connected by the system bus 27.

Figure 1:
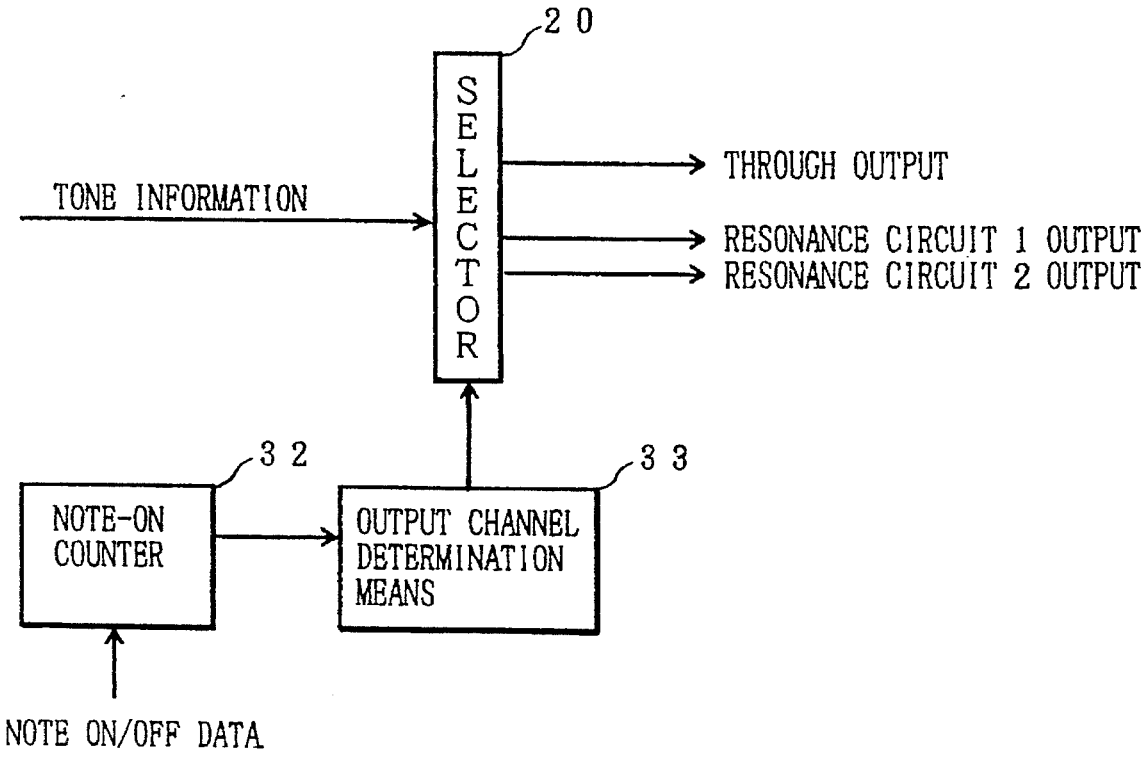
FIG. 1 is a diagram illustrating the arrangement of the essential section of an electronic musical instrument according to a first invention.

FIG. 1 illustrates the arrangement of the essential section, the feature of the present invention, that selects a resonance circuit in consonance with the number of depressed keys.

A note-on counter 32 is provided in the RAM 15. Each time an ON/OFF event has occurred, the note-on counter 32 counts the number of currently depressed keys by employing the ON/OFF data that are received from the keyboard 17 or the MIDI interface 10, and sends a count value to output channel determination means 33.

The function of the output channel determination means 33 is accomplished by the CPU 11, which employs an output channel determination table that is provided in the ROM 14. Upon receipt of data from the note-on counter 32, the CPU 11 examines the output channel determination table in the ROM 14 to find an output channel that corresponds to a depressed key count, and sends the output channel data to the selector 20.

The selector 20 receives a tone signal that is generated by the tone generator 18 and a signal that is output by the output channel determination means 33.

In response to a signal from the output channel determination means 33, i.e., a signal from the CPU 11 for selecting an output channel, the selector 20 selects a target resonance circuit by using, for example, a switch. Reverberation or resonance is then added to the tone information at a specific output channel (resonance circuit) and the resultant data is output.

With the above described arrangement, upon the depression of a key by a player, the ON/OFF event is detected by the scanning circuit and a detection signal is transmitted to the CPU 11. In response to that signal, the CPU 11 prepares, in the RAM 15, a map that shows the key states at the keyboard 17; selects a timbre and sound effect that have been designated at the panel section 12 and then stored in the RAM 15; and uses a counter in the RAM 15 to count the number of keyboard keys that are depressed.

Then, for example, when the simultaneously depressed key count is from 1 to 3, the data are output via a through output terminal; when it is from 4 to 7, the data are output from a resonance circuit 1; and when it is 8 or greater, the data are output from a resonance circuit 2. In this manner, a musical tone is changed during a performance by adding resonance or reverberation in consonance with the simultaneously depressed key count on the keyboard 17, and musical tones close to those produced during a live performance are generated.

Figure 5:
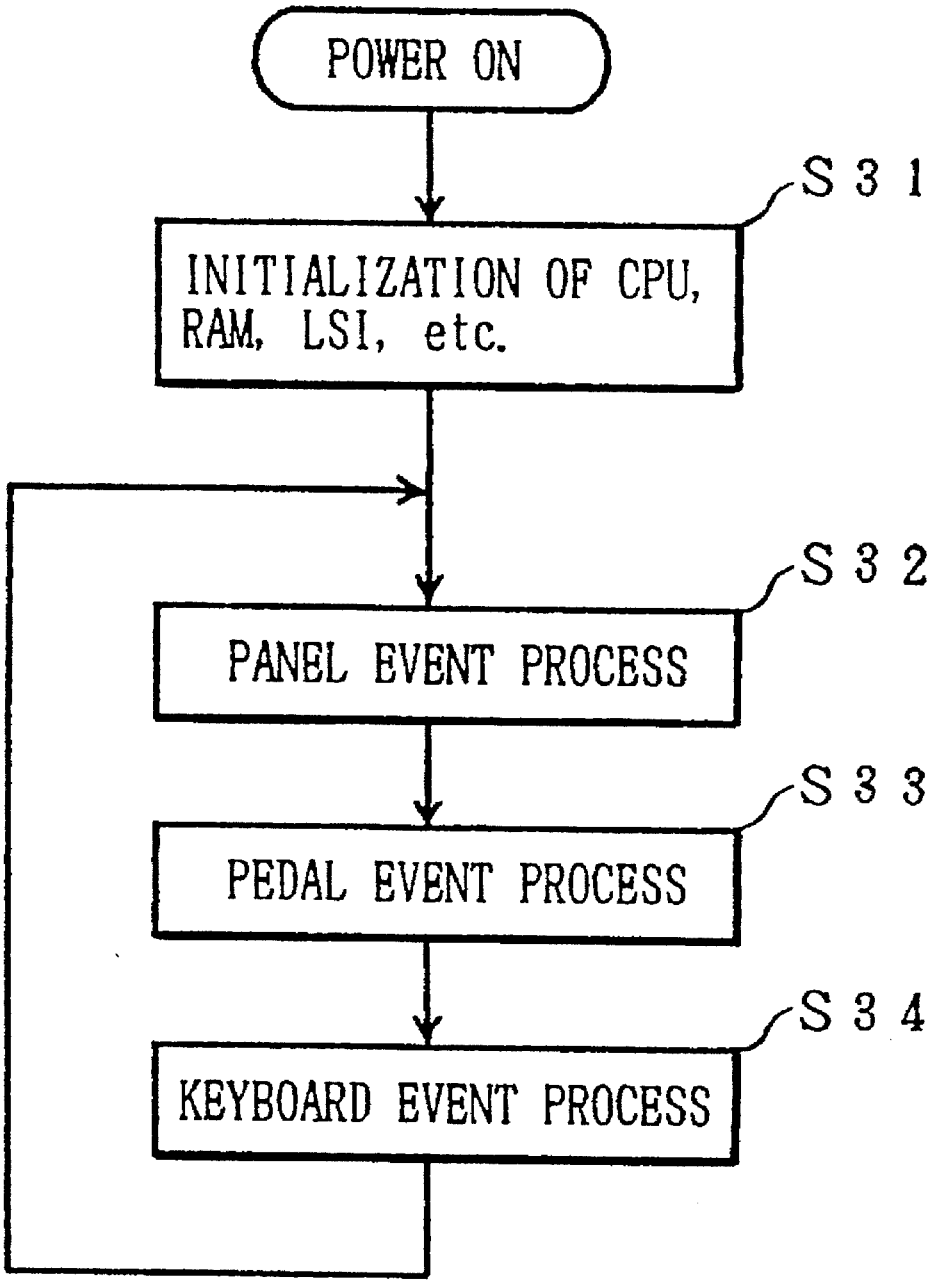
FIG. 5 is a flowchart showing a general process for an embodiment of the first invention.

FIG. 5 is a flowchart for the general process of this embodiment.

At power on, first, the CPU 11, the RAM 15, an LSI, etc. are initialized (step S31).

Sequentially, a panel event process is performed (step S32). This process concerns the panel section 12. In consonance with the individual switch states on the panel section 12, for example, an LED is set on, a timbre is changed to a designated one, or chorus or reverberation is added.

A pedal event process is then performed (step S33). With a piano as an example, when a damper pedal is held down, reverberation is sustained even though a key is released. Or when a soft pedal is held down, a timbre is changed or volume is decreased. Also, during this process a note that corresponds to a depressed key is produced. The details will be described later, while referring to FIG. 6.

Next, a keyboard event process is performed (step S34). This process is a tone-ON/tone-OFF process performed in consonance with a key-ON/key-OFF event. Its details will be explained later, while referring to FIG. 8.

In the general process, the above described procedures are repeated each time an event has occurred until power is turned off.

Figure 6:
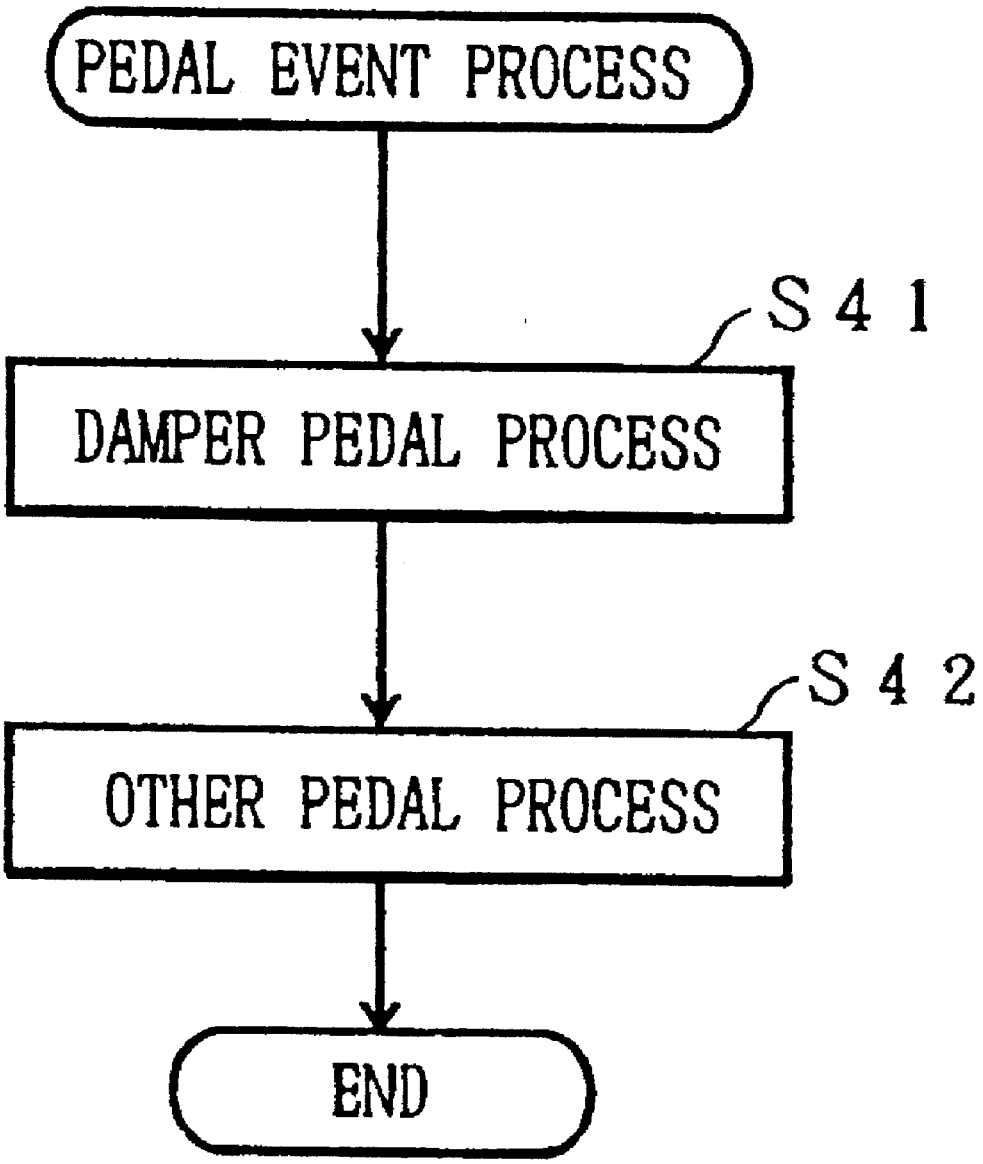
FIG. 6 is a flowchart for a pedal event process for the embodiment of the first invention.

FIG. 6 is a flowchart for the pedal event process. When an event has occurred, this process is performed following the panel event process.

Included in the pedal event process are a damper pedal procedure and an other-pedal procedure. The damper pedal process is performed first (step S41). This process will be described later while referring to FIG. 7.

Then, a process for other pedals, such as a soft pedal and a loud pedal, is performed (step S42). A flag is set or reset in consonance with an ON/OFF event, or a slider of a variable resistor is displaced in consonance with the distance that the pedal is depressed to control an output voltage. When this processing is ended, the pedal event process is terminated.

Figure 7:
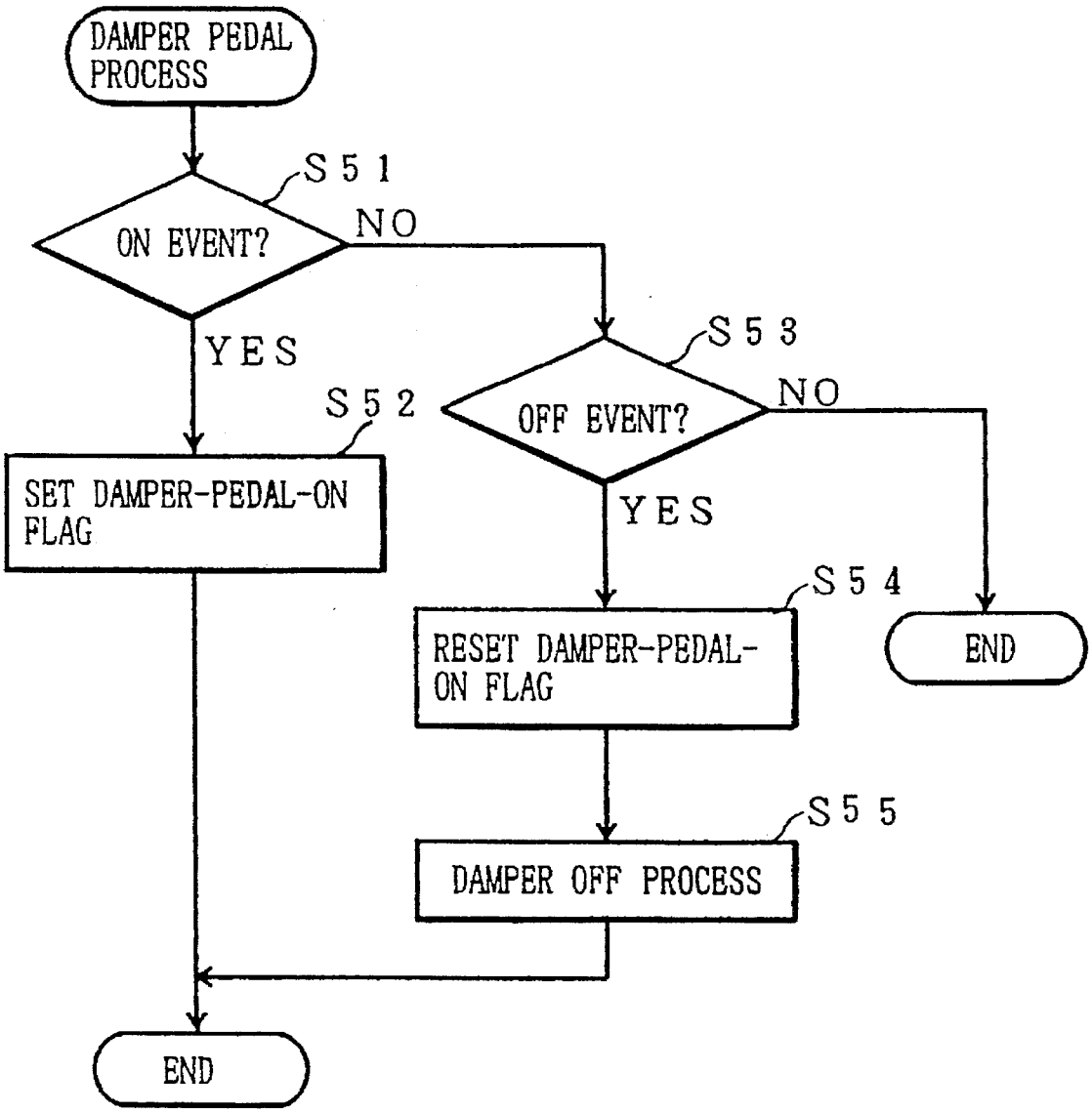
FIG. 7 is a flowchart for a damper pedal process for the embodiment of the first invention.

FIG. 7 is a flowchart showing the procedures for the damper pedal process.

In this process, first, a check is performed to determine whether or not an ON event for the damper pedal has occurred (step S51). When the damper pedal has been newly depressed, i.e., when an ON event has occurred, a flag in a storage area of the RAM 15 is set to indicate that the damper pedal is depressed (step S52). The damper pedal process is then terminated.

If, at step S51, an ON event for the damper pedal has not occurred, a check is performed to determine whether or not an OFF event for the damper pedal has occurred (step S53). When an OFF event for the damper pedal has occurred, the flag that was set to indicate the damper pedal is in the ON state is reset (step S54).

Then, the damper pedal-OFF process is performed (step S55). More specifically, a tone-OFF process is performed to halt the production of a musical tone that was sustained by holding down the damper pedal following the depression of a key. The damper pedal-OFF process is terminated.

If, at step S53, an OFF event for the damper pedal has not occurred, neither an ON nor OFF event for the damper pedal has occurred, and this process is terminated without performing any procedures.

As described above, the damper pedal process is a tone-OFF process for halting a musical tone that is sustained by holding down the damper pedal following the depression of a key. More specifically, the damper pedal process halts the production of a musical tone that has been sustained, even though the key was released, by holding down the damper pedal.

Figure 8:
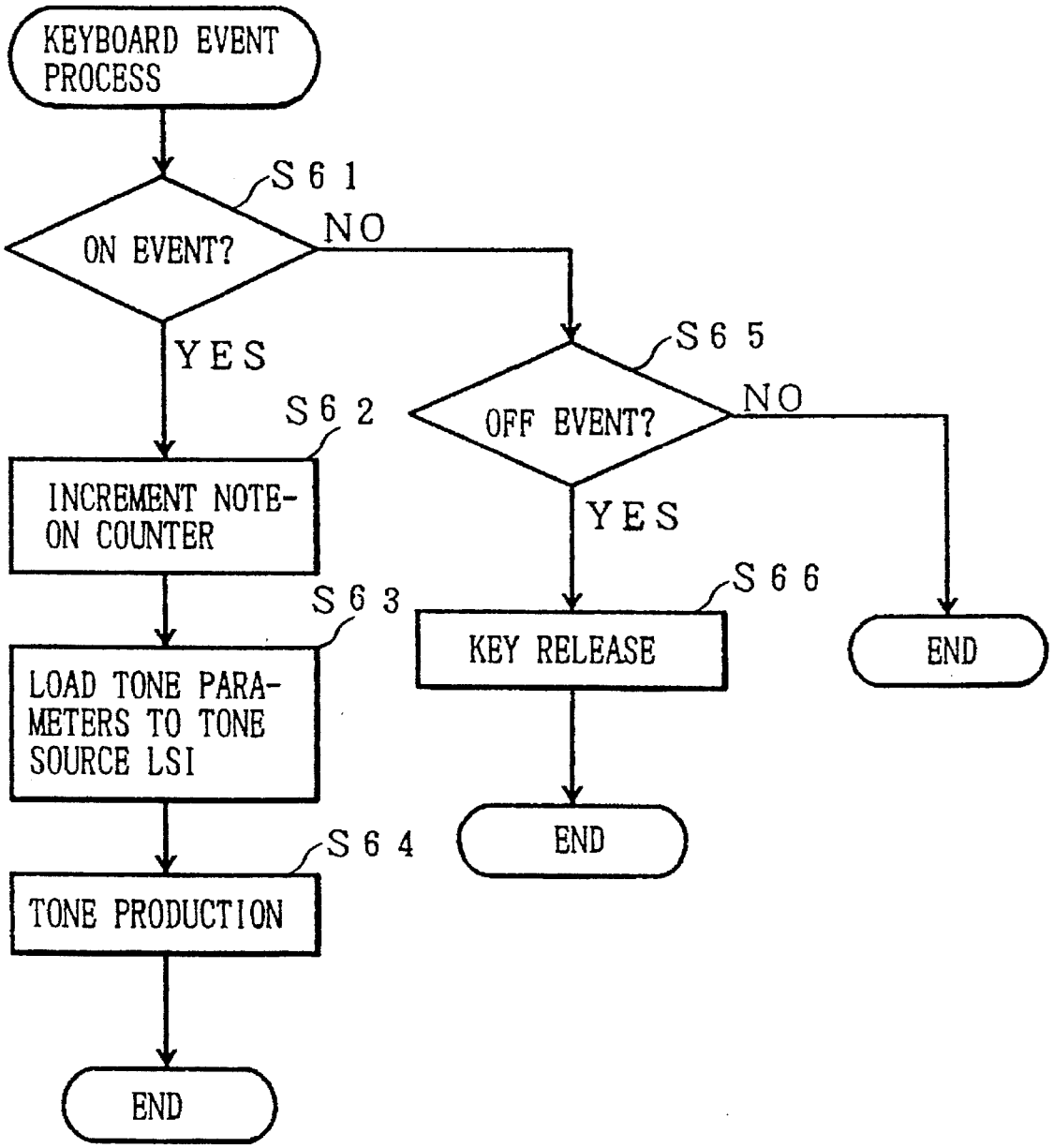
FIG. 8 is a flowchart for a keyboard event process for the embodiment of the first invention.

FIG. 8 is a flowchart showing the procedures for the keyboard event process.

In this process, first, a check is performed to determine whether or not an ON event on the keyboard 17 has occurred (step S61). When an ON event has occurred, a value held by the note-on counter 32 is incremented (step S62).

Sequentially, tone parameters are loaded to a tone source LSI (step S63). The tone parameters loaded to the LSI are an attack speed that represents the rise of a wave, an attack level that shows the distance a wave rises, a decay speed (release speed) that shows the fall of a wave, a decay level that shows the distance the wave falls, a read-out frequency value (for tone production), a start address for reading a waveform memory, etc.

Tone production is then performed (step S64). More specifically, the CPU 11 sends a tone production command to the LSI, and when a musical tone is generated, a process for one event is terminated. Such a process is repeated each time an event has occurred.

If, at step S61, no ON event has occurred, a check is performed to determine whether or not an OFF event has occurred (step S65). When an OFF event has occurred, a key release process, which will be explained while referring to FIG. 9, is performed (step S66), and a process for one event is terminated.

When, at step S65, no OFF event has occurred, i.e., neither an ON nor an OFF event has occurred, the keyboard event process is terminated without performing any procedures.

Figure 9:
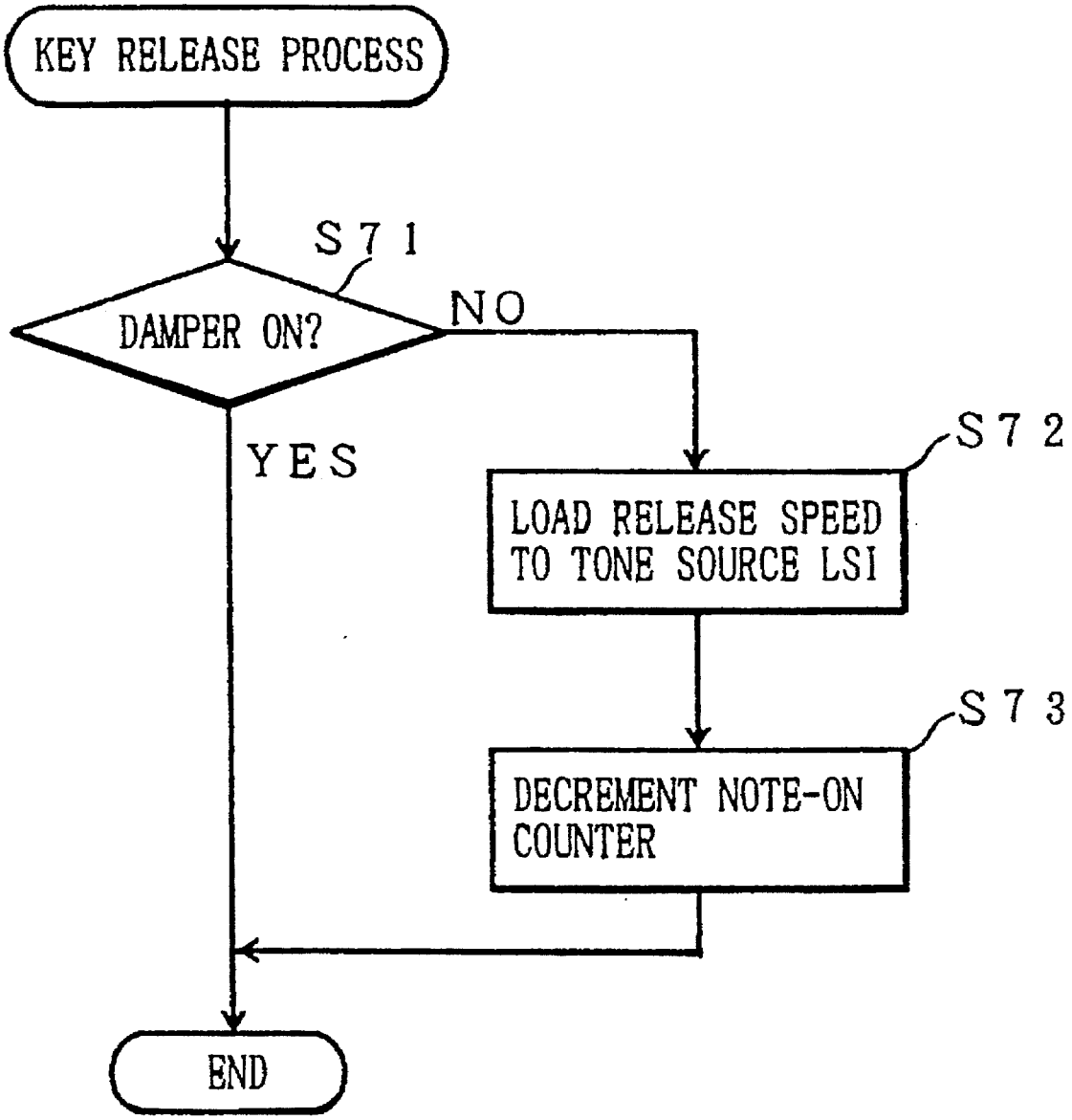
FIG. 9 is a flowchart for a key release process for the embodiment of the first invention.

The key release process will be now explained while referring to FIG. 9.

In this process, first, a check is performed to determine whether or not a damper pedal is depressed (step S71). When the damper pedal is in the ON state, this process is terminated without performing any other procedures. When the damper pedal is in the OFF state, a release speed is read from the ROM 14 and loaded to the tone source LSI (step S72), and a value held by the note-on counter 32 is decremented (step S73). The key release process is then terminated.

Figure 10:
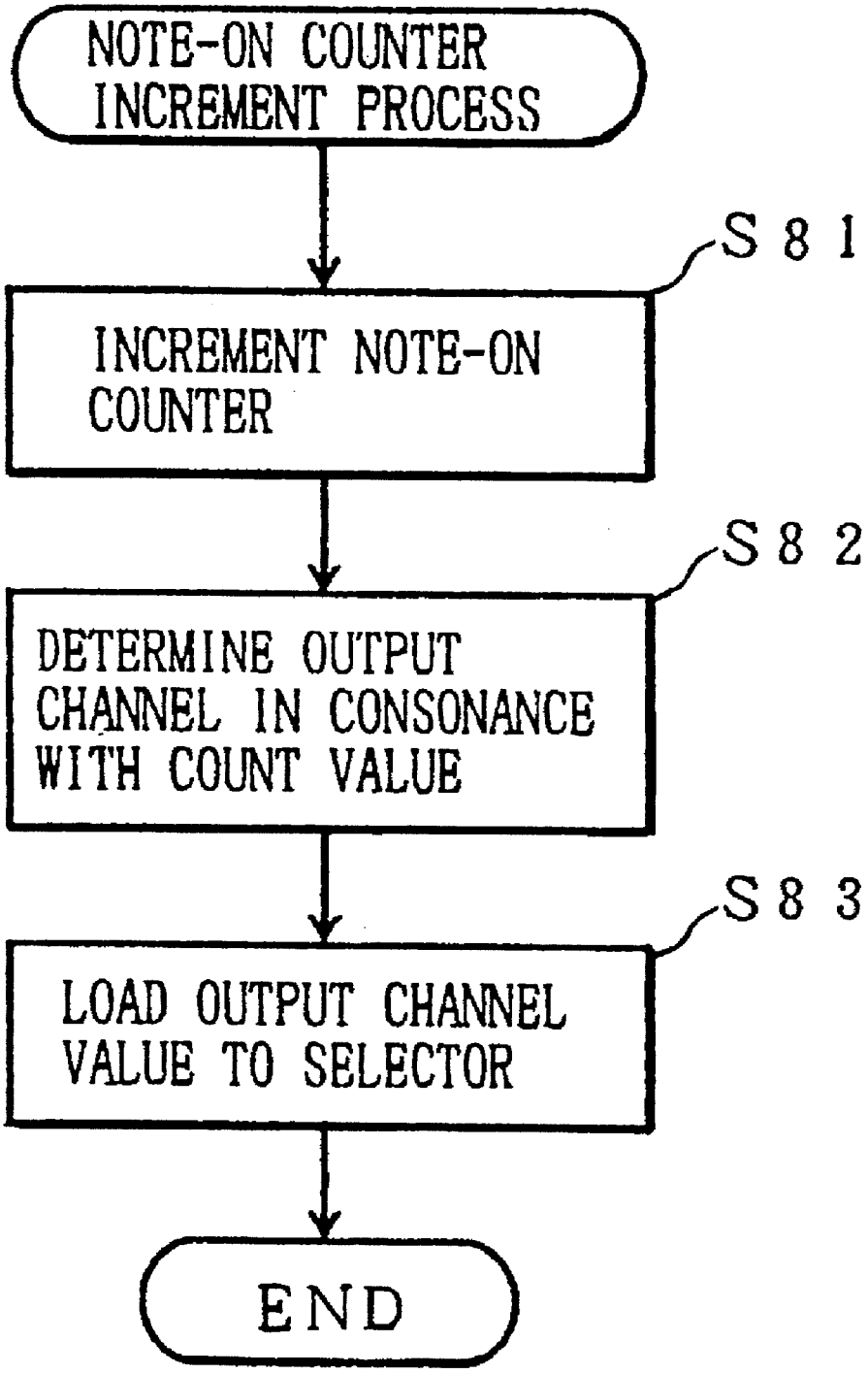
FIG. 10 is a flowchart for a note-ON counter increment process for the embodiment of the first invention.

The increment process for the note-on counter 32 will now be described while referring to FIG. 10.

In this process, first, a value held by the note-on counter 32 is incremented (step S81), and an output channel is then determined (step S82). More specifically, the CPU 11 reads an output channel value from the ROM 14 by referring to the incremented count value, and loads the output channel value to the selector 20 (step S83). In consonance with that value, the selector 20 selects an output channel (resonance circuit) for tone production.

Figure 11:
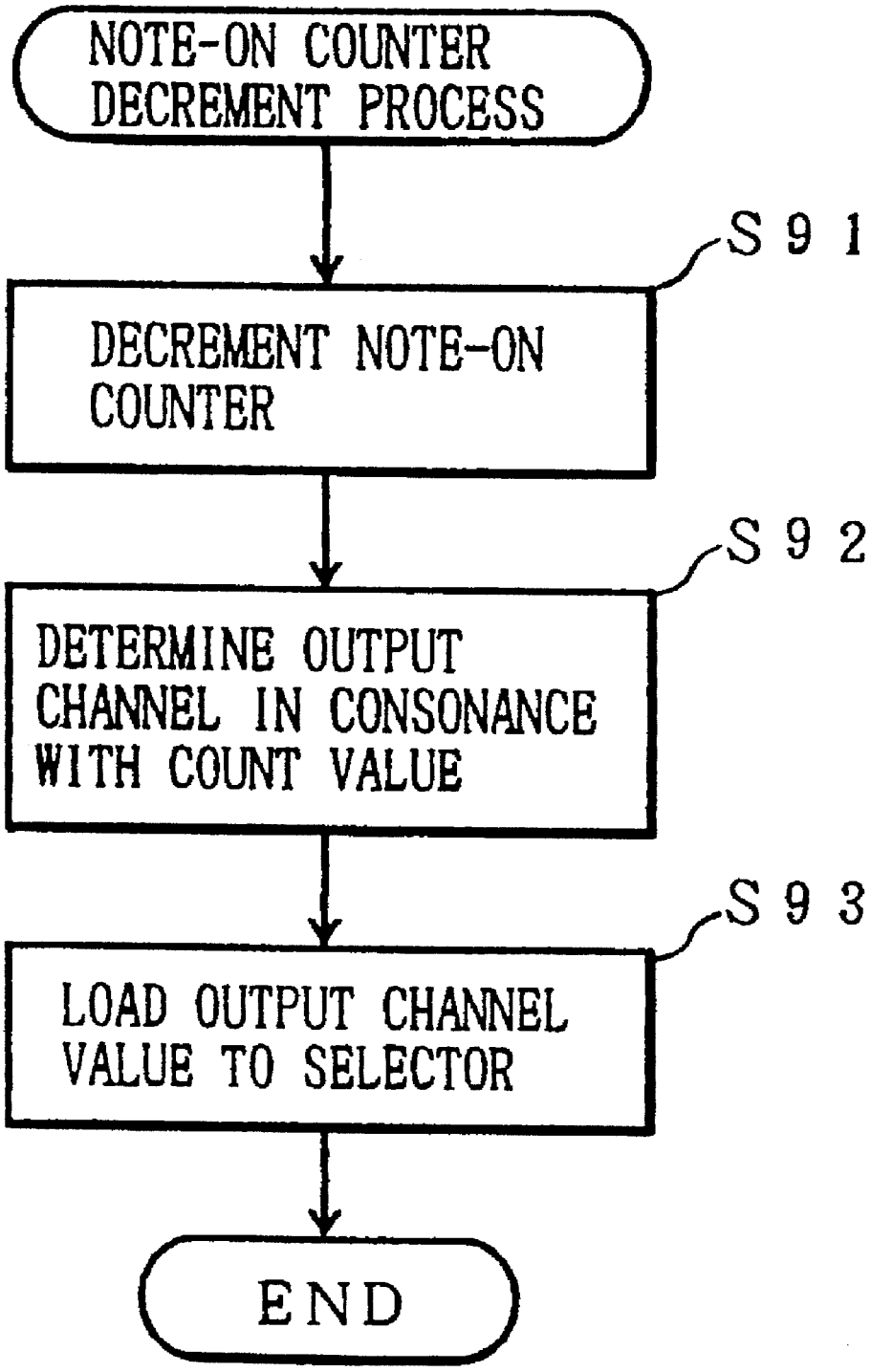
FIG. 11 is a flowchart for a note-ON counter decrement process for the embodiment of the first invention.

The decrement process for the note-on counter 32 will be explained while referring to FIG. 11.

In this process, first, a value held by the note-on counter 32 is decremented (step S91), and then an output channel is determined (step S92). More specifically, in consonance with the decremented count value, the CPU 11 reads an output channel value by referring to the table in the ROM 14 and loads the output channel value to the selector 20 (step S93). Upon the receipt of that value, the selector 20 selects the corresponding output channel (resonance circuit) for tone production.

By repeating the procedures that are described above in detail, it is possible during a performance to change sound effects for a musical tone in consonance with the number of keys that are depressed on the keyboard 17.

Although the employment of a through circuit and two resonance circuits has been explained in this embodiment, the present invention is not limited in the number of the circuits that can be employed, and a resonance circuit count may be varied. Also, although the selection of a resonance circuit is performed in consonance with the number of keyboard keys that are simultaneously depressed, such a selection may be performed in consonance with the tone range of a keyboard, or both of these methods may be jointly employed.

As described above, according to the present invention it is possible to vary the intensity of sound effects, such as reverberation and resonance, by altering output channels in consonance with a depressed key count, and thereby ensure the generation of music that is close to that produced by an acoustic piano.

An explanation will now be given for the second invention, in which control of a resonant tone production means 21 is based on the count of channels that are simultaneously in a note-on state.

Since sections that are identical with or correspond to those in the first invention have been previously described, only the section that differs from those of the first invention will be explained here.

Figure 12:
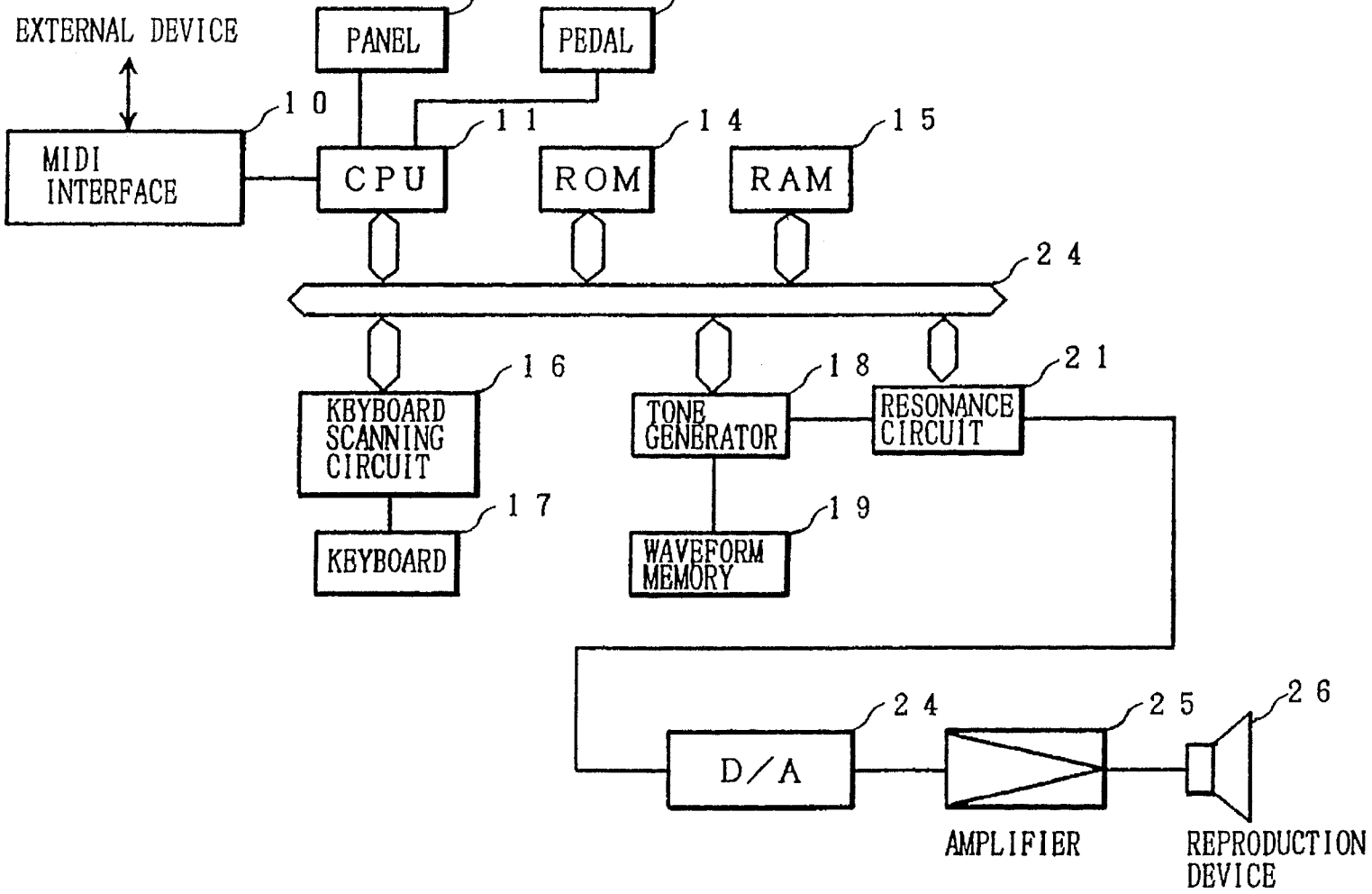
FIG. 12 is a diagram illustrating the general arrangement of an electronic musical instrument according to the second invention.

FIG. 12 is a schematic block diagram illustrating the general arrangement of an electronic musical instrument according to the second invention.

A CPU 11 controls the individual sections of an electronic musical instrument by executing a control program that is stored in a program memory in a ROM 14. The CPU 11 also reads a control parameter, which corresponds to the number of simultaneously depressed keys, from a resonance circuit control parameter determination table, which is provided in the ROM 14, and sends the control parameter to the resonance circuit 21.

Provided in the ROM 14 are a table for determining an attack speed, an attack level, a decay speed, a decay level, etc., and a table for determining a control parameter by using a count value, both of which tables are related to the prevent invention.

In this embodiment, only one resonance circuit 21 is provided in, for example, an electronic piano to simulate the conditions required for the production of sound effects such as reverberation and resonance.

With the above described arrangement, during a performance the resonance circuit 21 is controlled by a parameter control signal, which is sent from the CPU 11 in consonance with the number of keys that are simultaneously depressed on the keyboard 17, a desirable sound effect is added to a tone signal that is transmitted from a tone generator 18, and a resonant tone, equivalent to that produced by strings and a frame, or reverberation is produced.

Figure 2:
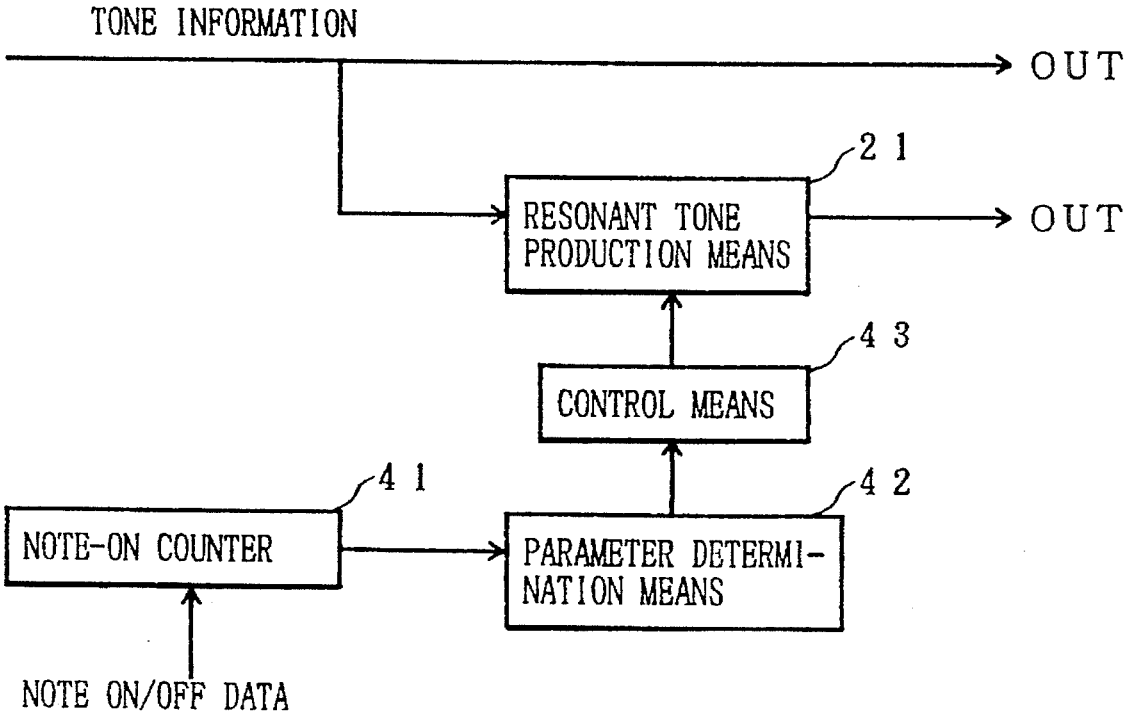
FIG. 2 is a diagram illustrating the arrangement of the essential section of an electronic musical instrument according to a second invention.

FIG. 2 is a schematic diagram illustrating the arrangement of a section, which is the feature of the second invention, that controls the resonance circuit 21 in consonance with a depressed key count.

A note-on counter 41 is provided in the RAM 15, together with a key depression map. Whenever an ON/OFF event has occurred, the note-on counter 41 employs ON/OFF data from a keyboard 17, or an MIDI interface 10, to count the keys that are currently depressed.

When an ON/OFF event has occurred, the CPU 11, which serves as parameter determination means 42, reads a count value held by the note-on counter 41, examines the control parameter determination table provided in the ROM 14 to obtain a control parameter value that corresponds to the count value, and transmits the read control parameter value to control means 43.

In consonance with the parameter value from the parameter determination means 42, the control means 43 alters the control parameter for the resonance circuit 21 so as to change the characteristic of the resonance circuit 21.

Then, the resonance circuit 21 adds sound effects, such as reverberation, chorus, volume, resonance, to a digital tone signal that is received from tone generator 18, and transmits the effect-added signal to a D/A converter 24 for tone release.

Although in this embodiment the parameter determination means 42 determines a parameter value by referring to a table in the ROM 14, it may instead employ a program for this purpose.

The processing of the electronic musical instrument of the second invention will now be described. Since the general process, the pedal event process, the damper pedal process, the keyboard process and the key release process in this invention are identical to those in the first invention, an explanation of them will not be given here.

Figure 13:
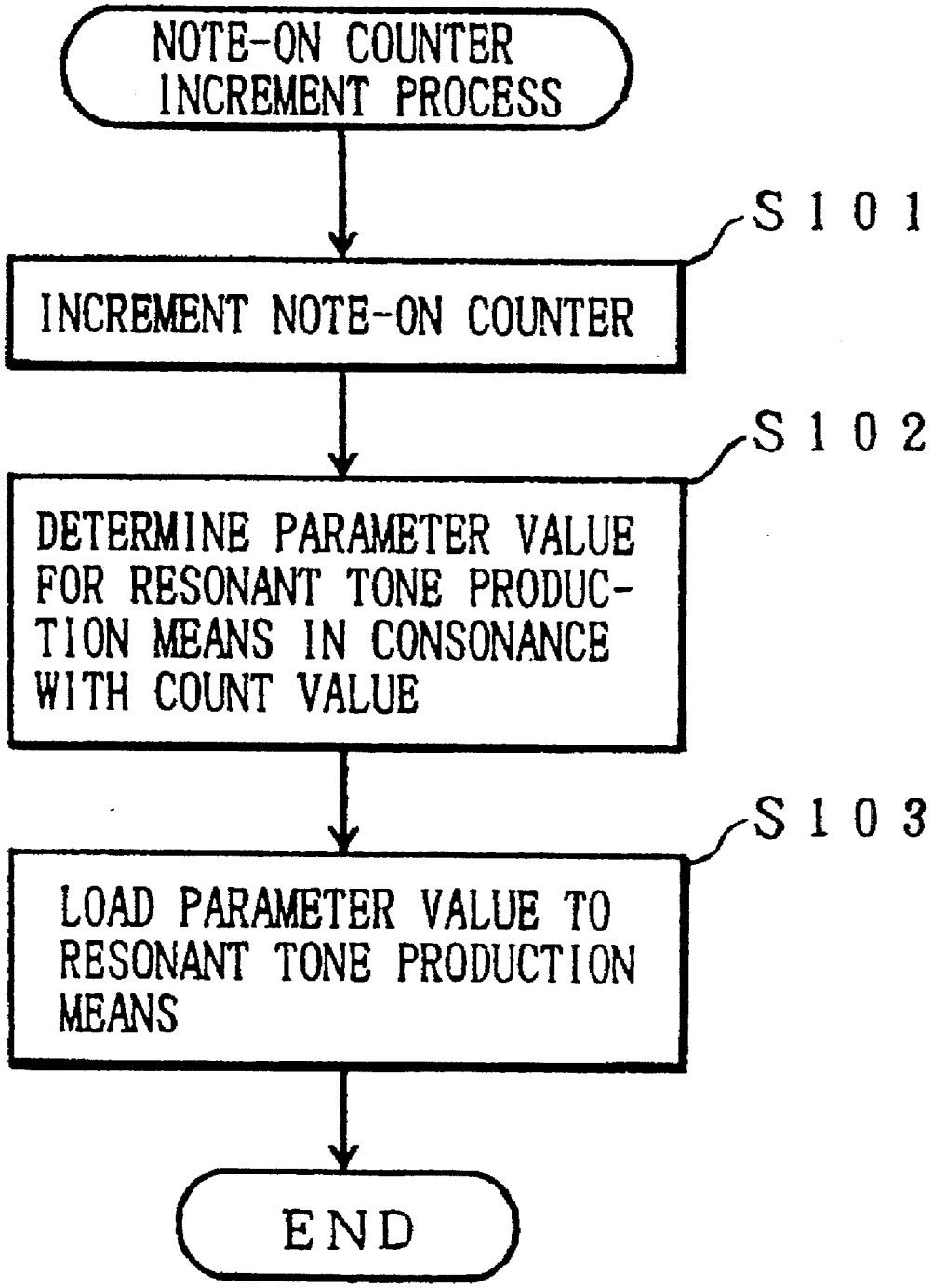
FIG. 13 is a flowchart for a note-ON counter increment process for an embodiment of the second invention.

An increment process for the note-on counter 41 will be explained while referring to FIGS. 2 and 13.

In this process, a value held by the note-on counter 41 is incremented (step S101), and a control parameter value, for the resonance circuit 21, that corresponds to the count value is determined (step S102). More specifically, the CPU 11 reads from the ROM 14 a parameter value that corresponds to the incremented count value, and loads that parameter value to the control section of the resonance circuit 21 (step S103). This control section employs the parameter value to control the resonance circuit, which adds resonance or reverberation.

Figure 14:
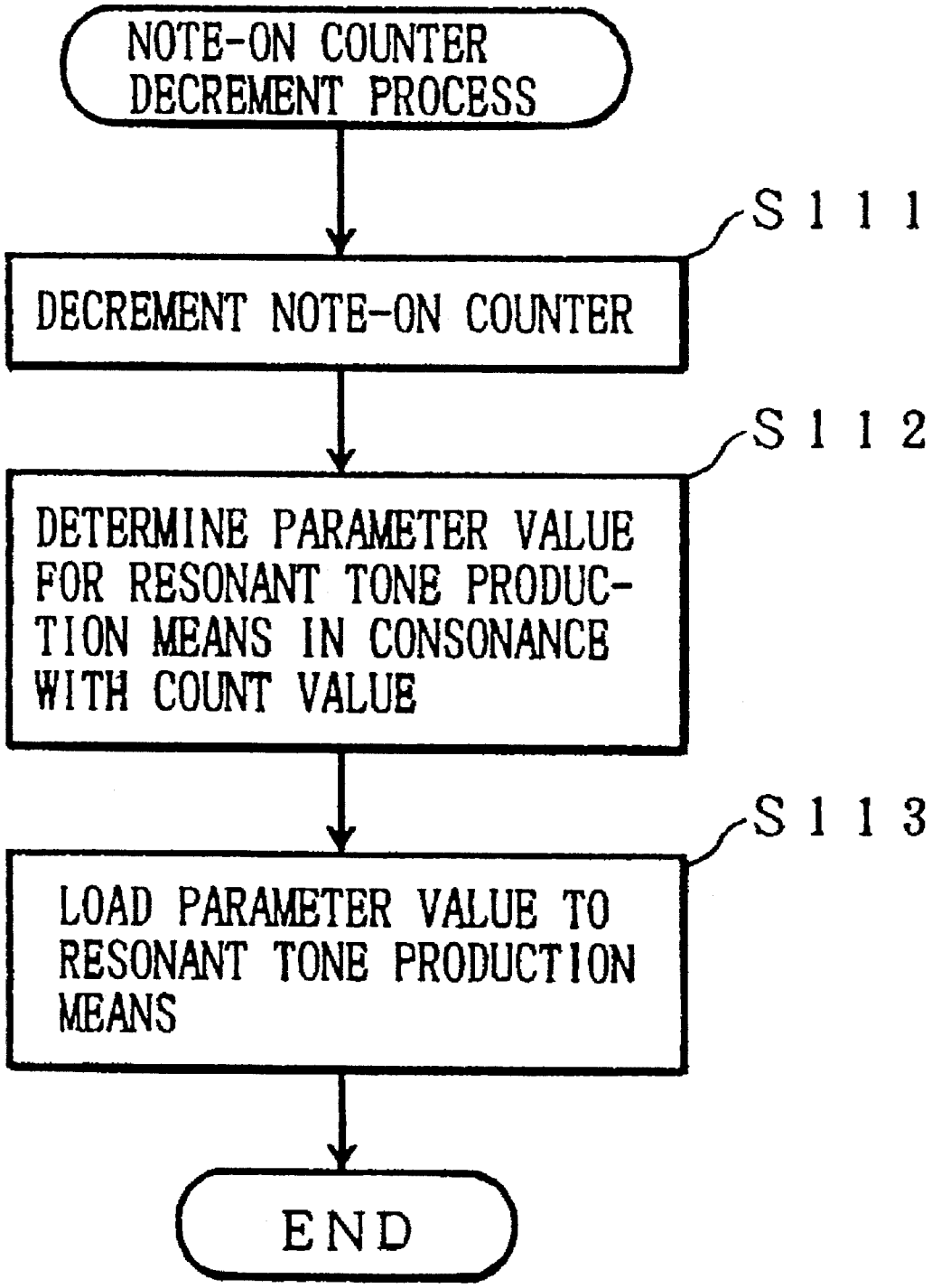
FIG. 14 is a flowchart for a note-ON counter decrement process for the embodiment of the second invention.

A decrement process for the note-on counter 41 will now be described while referring to FIGS. 2 and 14.

In this process, first, a value held by the note-on counter 41 is decremented (step Slll), and then a control parameter value, for the resonance circuit 21, that corresponds to the count value is determined (step S112). More specifically, the CPU 11 examines the table in the ROM 14 to search for a control parameter value that corresponds to the decremented count value, and loads the parameter value to the control section of the resonance circuit 21 (step Sl13). The control section employs the parameter value to control the resonance circuit 21, which adds resonance or reverberation.

Since, by repeating the above processing, sound effects are altered in consonance with the number of keys that are depressed on the keyboard 17, variable sound effects can be provided by manipulation of a keyboard or a pedal during a performance.

Although in this embodiment a control parameter value for the resonance circuit is determined by the number of keys that are simultaneously depressed on the keyboard, a control parameter value may be determined in consonance with the tone ranges of depressed keys, or both of these methods may be jointly employed.

As described above, according to the present invention it is possible to vary the intensity of sound effects, such as reverberation and resonance, by altering a control parameter value for the resonance circuit in consonance with a depressed key count, and thereby ensure the generation of music that is close to that produced by an acoustic piano.

An explanation will now be given for the third invention, in which control of an effect addition means 53 is based on the number of channels that are simultaneously in a note-on state.

Since sections that are identical with or correspond to those in the first invention have been previously described, only the section that differs from those of the first invention will be explained here.

Figure 15:
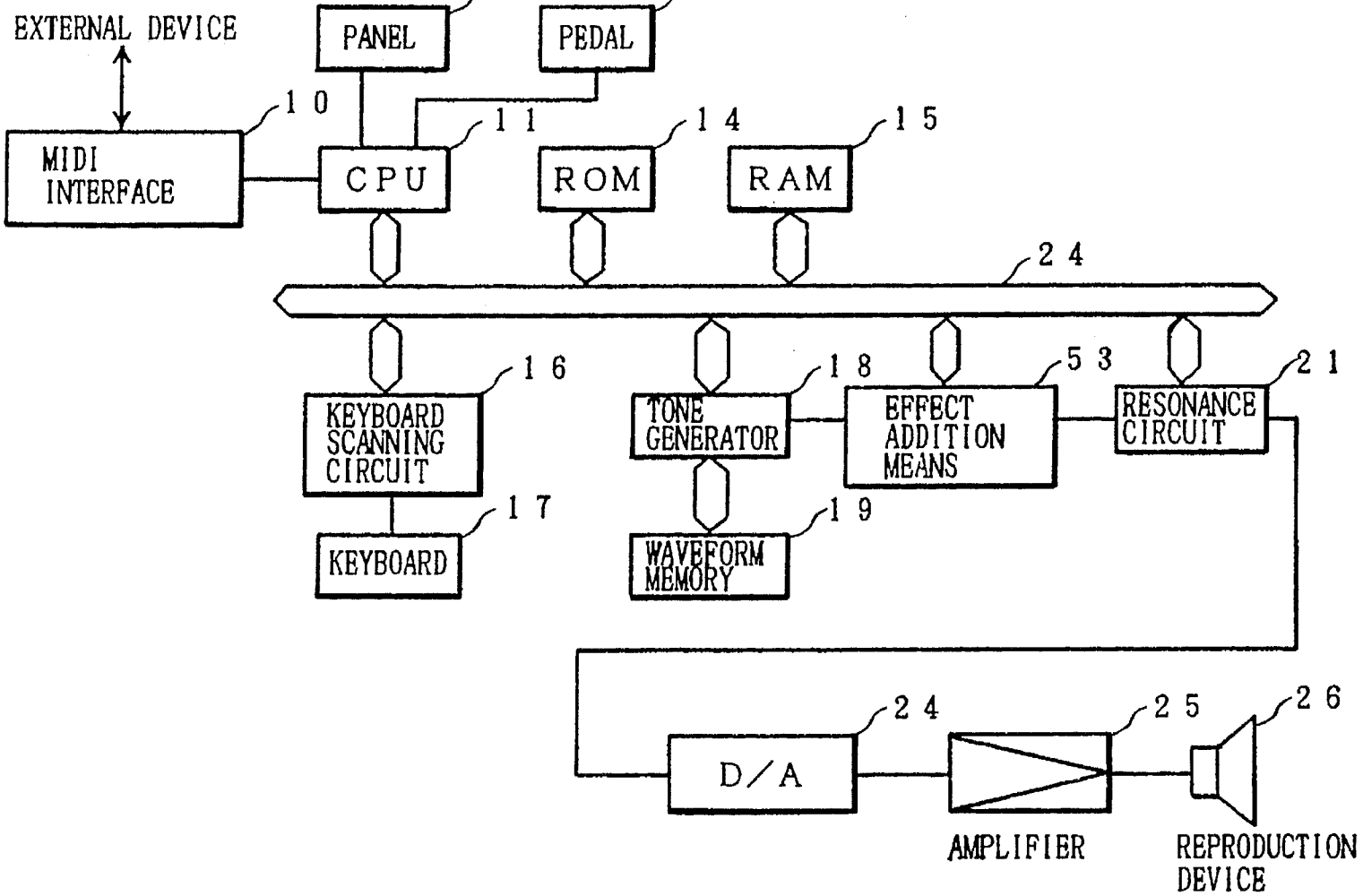
FIG. 15 is a diagram illustrating the general arrangement of an electronic musical instrument according to the third invention.

FIG. 15 is a schematic block diagram illustrating the general arrangement of an electronic musical instrument according to the third invention.

A CPU 11 controls the individual sections of the electronic musical instrument by executing a control program that is stored in a program memory in a ROM 14. The CPU 14 also examines a resonance circuit control parameter determination table, which is provided in the ROM 14, to find a control parameter that corresponds to the number of keys that are simultaneously depressed, and sends the control parameter to a resonance circuit 21.

Provided in the ROM 14 are a table for determining an attack speed, an attack level, a decay speed, a decay level, etc., and a table for determining a control parameter by referring to a count value, both of which tables are related to the present invention.

The effect addition means 53 is, for example, a multiplier. In consonance with the number of keys that are simultaneously depressed on a keyboard 17, the effect addition means 53 adds a desirable volume alteration to a tone signal that is received from a tone generator 18, and transmits the resultant tone signal to the resonance circuit 21.

With such an arrangement, during a performance the CPU 11 reads the count value of simultaneously depressed keys held by the counter in the RAM 15, finds a multiplication coefficient that corresponds to the count value by examining a multiplication coefficient determination table in the ROM 14, and sends that coefficient to the effect addition means 53. The effect addition means 53 adds a desirable volume (amplitude) change to a tone signal, and transmits the resultant tone signal to the resonance circuit 21.

In an electronic piano, for example, the resonance circuit 21 simulates the conditions required for the production of sound effects, such as reverberation or resonance, and adds a sound effect selected at a panel section 12, such as reverberation, chorus, or tremolo, to a tone signal received from the effect addition means 53.

Figure 3:
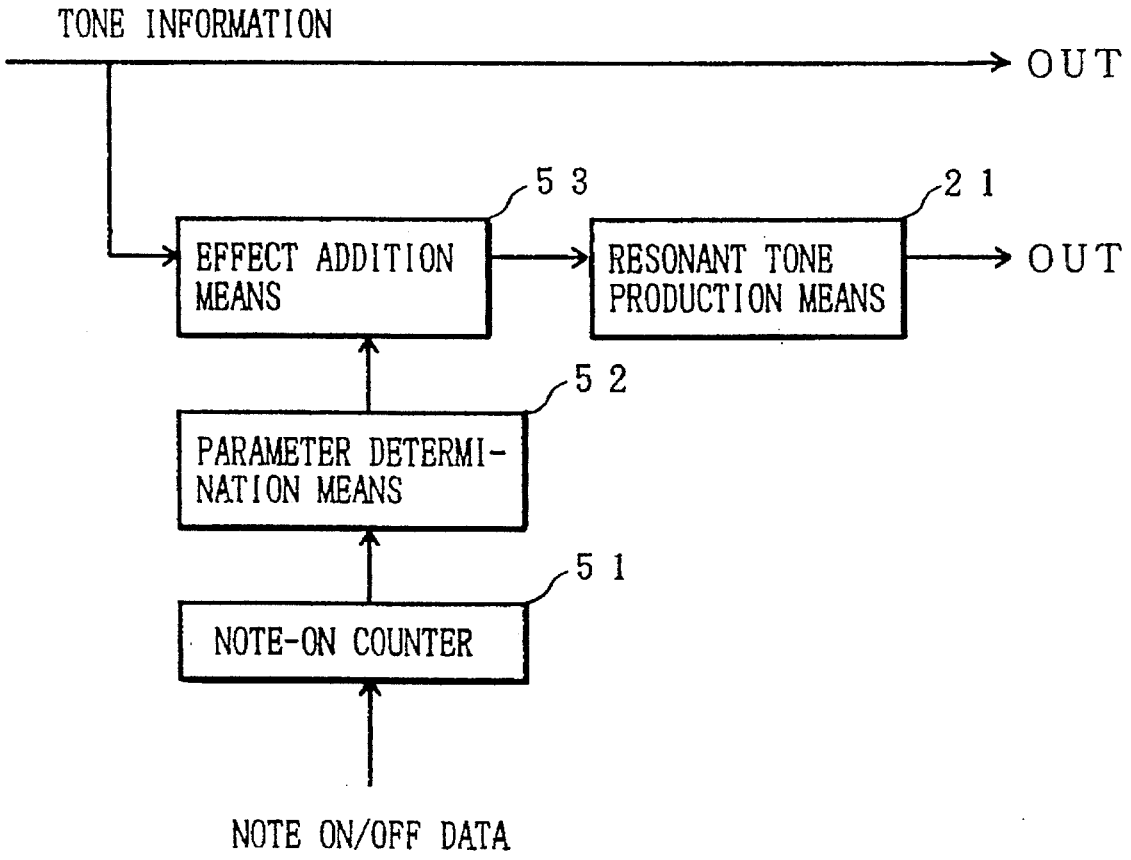
FIG. 3 is a diagram illustrating the arrangement of the essential section of an electronic musical instrument according to a third invention.

FIG. 3 shows the arrangement of the essential section, which is the feature of the third invention, that controls the effect addition means 53 in consonance with a depressed key count. In this embodiment, a multiplier is employed for the effect addition means.

Each time an ON/OFF event has occurred, a note-on counter 51, provided in the RAM 15, employs ON/OFF data from the keyboard 17, an MIDI interface 10, etc., and counts the keys that are currently depressed.

At the occurrence of the ON/OFF event, the CPU 11 that serves as parameter determination means 52 reads a count value held by the note-on counter 51, examines the control parameter determination table in the ROM 14 to find a multiplication coefficient that corresponds to the count value, and sends that coefficient to a multiplier 53.

The multiplier 53 varies a volume (amplitude) in consonance with the multiplication coefficient received from the parameter determination means 52, and transmits it to the resonance circuit 21.

In consonance with the received volume, the resonance circuit 21 then adds sound effects, such as reverberation and chorus, to a digital tone signal transmitted from the tone generator 18, and sends the effect-added tone signal to a D/A converter 24 where the tone signal is converted into an analog signal. The analog signal is then transmitted to an amplifier 25 where it is amplified. The signal is then released by a reproduction device 26.

Although a control parameter determination table has been employed in this embodiment, a control parameter may be obtained by executing a program.

The processing of the electronic musical instrument of the third invention will now be described. As the general process, the pedal event process, the damper pedal process, the keyboard process, and the key release process are identical to those in the first invention, no explanation of them will be given here.

Figure 16:
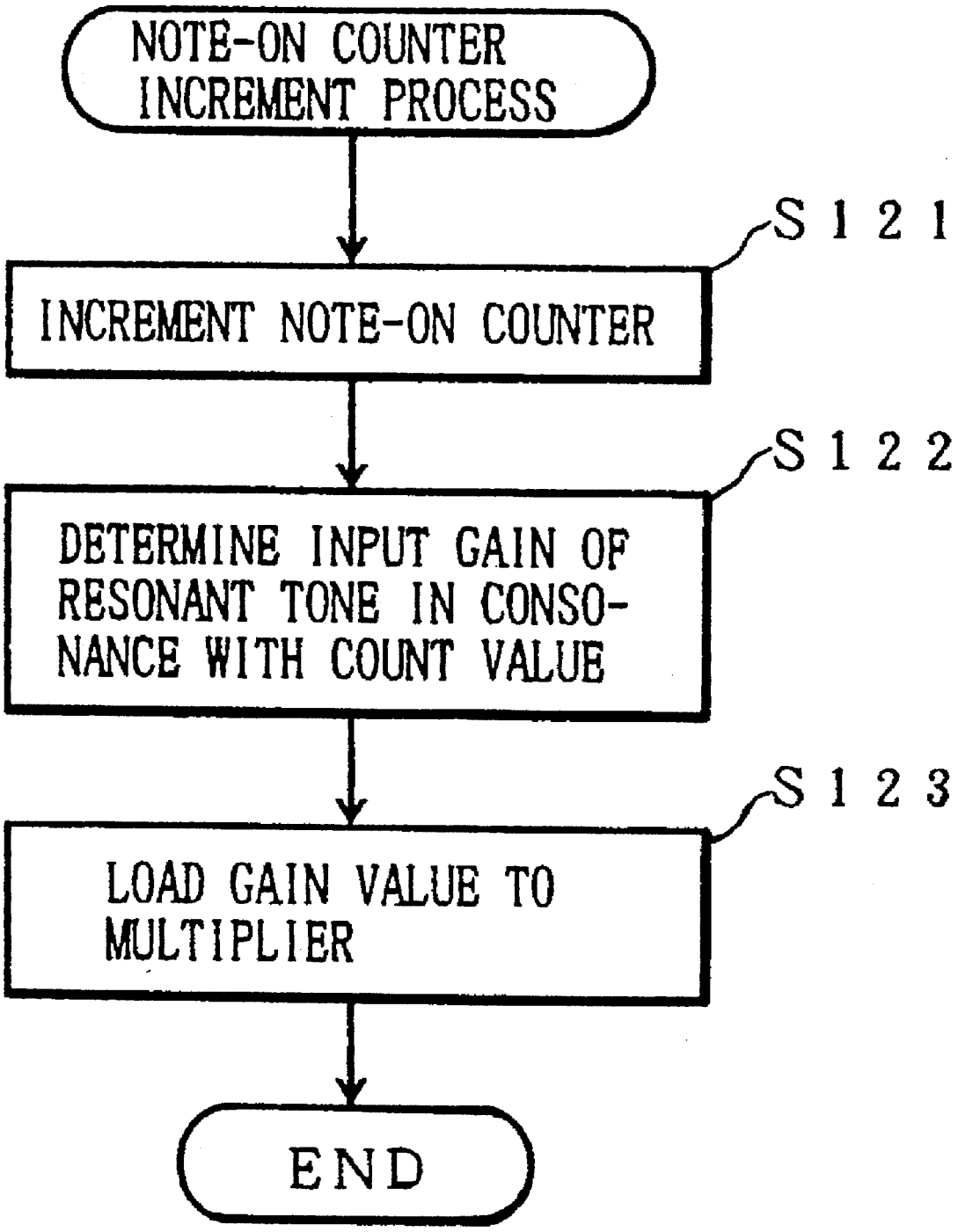
FIG. 16 is a flowchart for a note-ON increment process for an embodiment of the third invention.

An increment process for the note-on counter 51 will be explained while referring to FIGS. 3 and 16.

In this process, first, a value held by the note-on counter 51 is incremented (step S121), and a multiplication coefficient, of the multiplier 53, that corresponds to the count value is determined (step S122). More specifically, the CPU 11 reads the incremented count value, reads from the ROM 14 a multiplication coefficient that corresponds to the count value, and loads the coefficient to the multiplier 53 (step S123). The multiplier 53 employs the multiplication coefficient to add volume alteration to a tone signal, and sends the resultant signal to the resonance circuit 21. The resonance circuit 21 then adds sound effects, such as resonance or reverberation.

Figure 17:
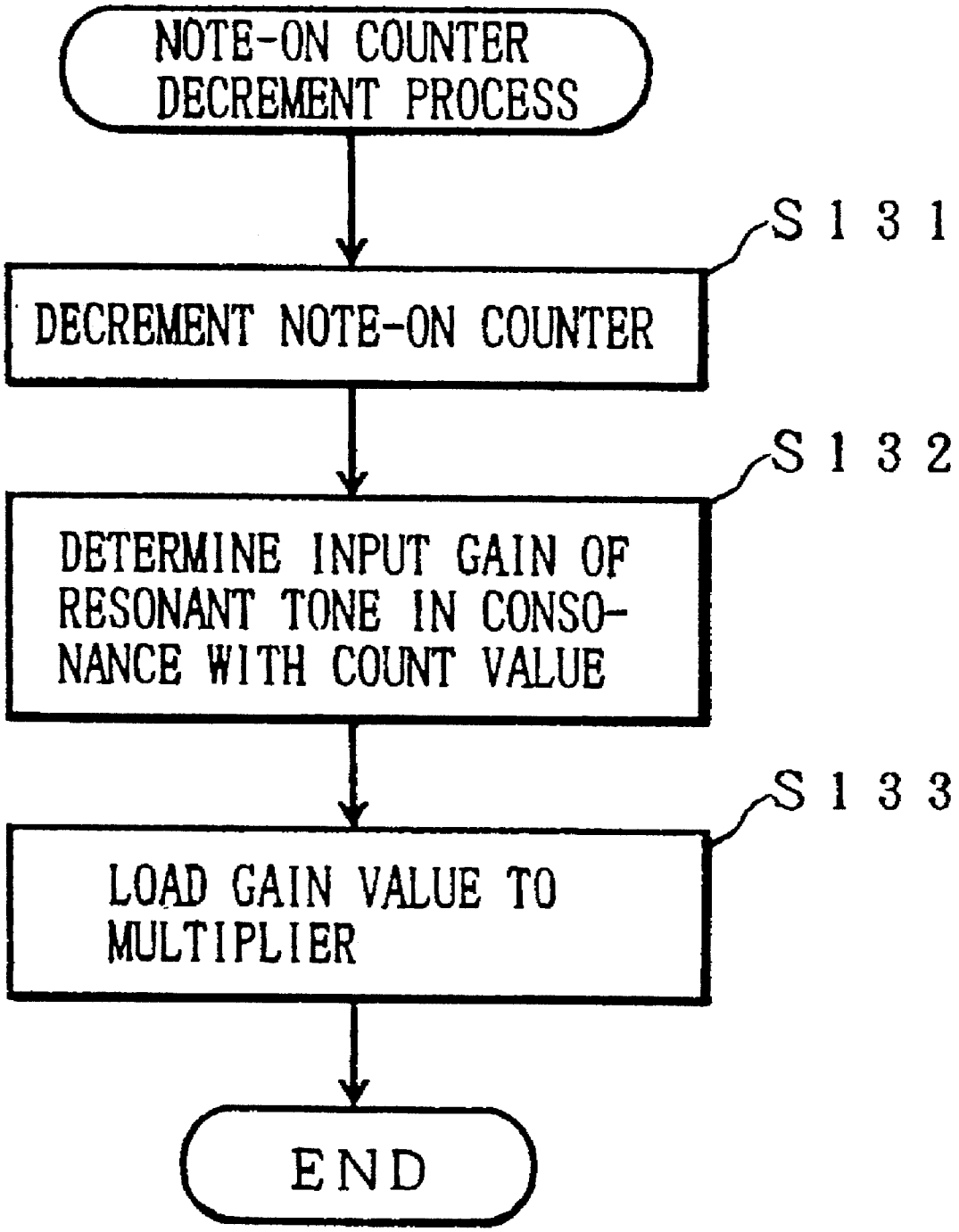
FIG. 17 is a flowchart for a note-ON decrement process for an embodiment of the third invention.
Figure 18:
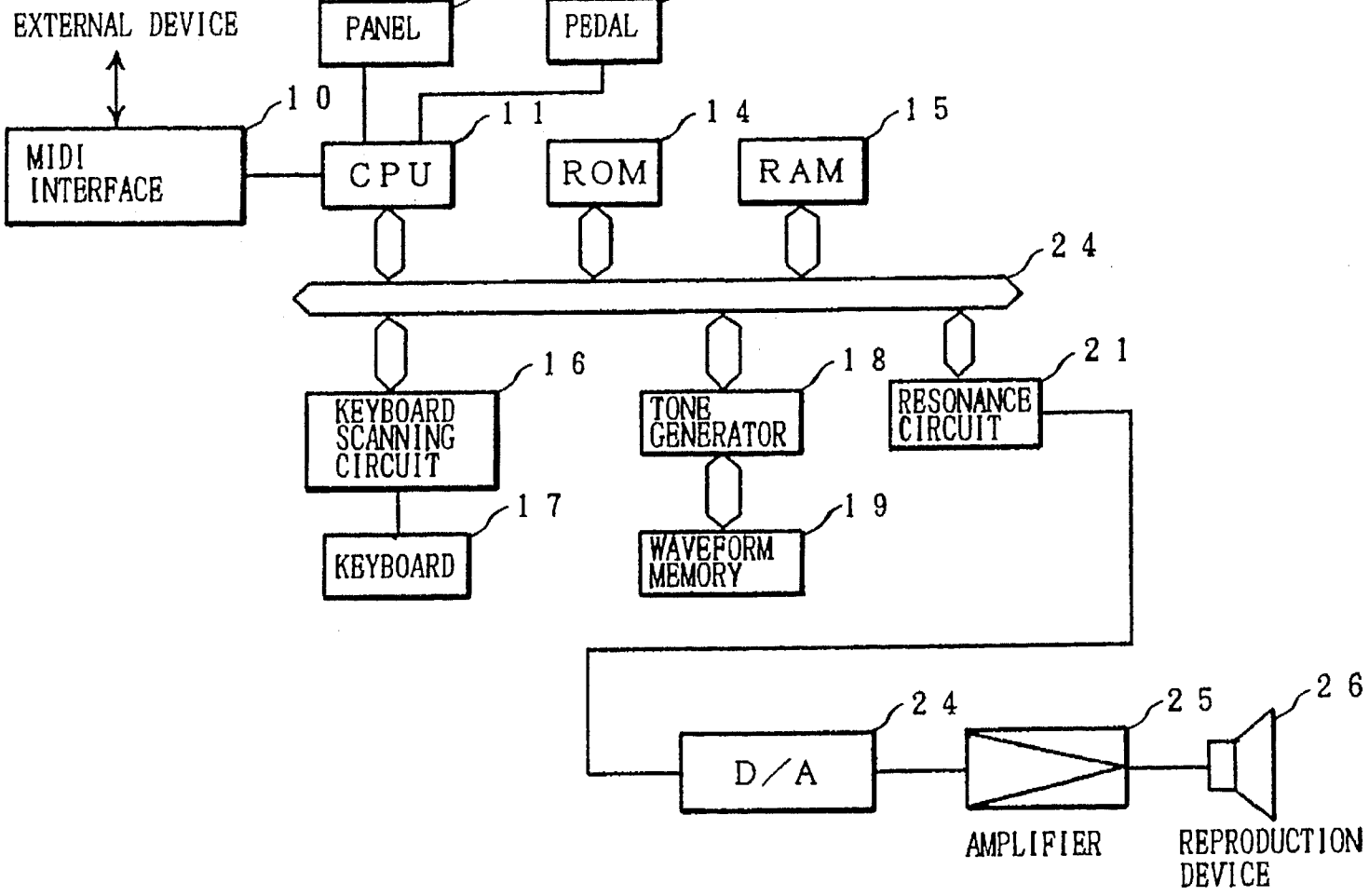
FIG. 18 is a diagram illustrating the general arrangement of a conventional electronic musical instrument.

A decrement process for a note-on counter 51 will be explained while referring to FIGS. 3 and 17.

In this process, first, a value held by the note-on counter 51 is decremented (step S131), and a multiplication coefficient, of the multiplier 53, that corresponds to the count value is determined (step S132). More specifically, the CPU 11 reads the decremented count value, reads from the ROM 14 a multiplication coefficient that corresponds to that count value, and loads the coefficient to the multiplier 53 (step S133). The multiplier 53 employs the received multiplication coefficient to provide volume alteration for a tone signal, and transmits the resultant signal to the resonance circuit 21. The resonance circuit 21 then adds sound effects, such as resonance or reverberation.

Since the process described above in detail is repeated to vary sound effects in consonance with the number of keys that are depressed on the keyboard 17, various sound effects can be provided during a performance by manipulating a keyboard or a pedal.

Although in this embodiment a multiplication coefficient of the multiplier 53 is determined based on the number of keys that are simultaneously depressed, a multiplication coefficient may be varied in consonance with the tone ranges of depressed keys, or both of these methods may be jointly employed.

As described above, according to the present invention, since volume received by the resonance circuit is varied by changing a multiplication coefficient of a multiplier in consonance with the number of keys that are depressed or that are in the tone-ON state, the intensity of sound effects, such as reverberation and resonance, can be varied, and the generation of music that is close to that produced by an acoustic piano is therefore ensured.

Although the preferred embodiment of the present inventions and the claims particularly point out the subject matter regarded as the inventions, various other modifications are contemplated as being within the scope of the inventions.

What is claimed is:

1. An electronic musical instrument in which desired musical sound effects, including resonance and/or reverberation effects, are provided to musical notes produced by the instrument, said instrument including a plurality of tone channel means having note-ON states, said instrument comprising:

a plurality of output channels through which musical notes are generated by the instrument, at least certain ones of said output channels having circuit means for providing a musical sound effect to the musical notes, the sound effect provided by the circuit means in one of said output channels differing from the sound effects provided by the circuit means in other output channels;

tone channel count means, for ascertaining a selected property of the tone channels that are in a note-ON state;

output channel determination means, for designating one of said output channels in consonance with the ascertainment made by said tone channel count means; and output channel selection means, for selecting said output channel that is designated by said output channel determination means, said output channel selected by said output channel selection means containing the circuit means providing the desired sound effect for the musical notes.

2. An electronic instrument according to claim 1, wherein said instrument has a keyboard with keys and wherein said tone channel count means counts the number of keys that are depressed in ascertaining the selected property of the tone channels.

3. An electronic musical instrument according to claim 1, wherein said instrument has a keyboard with keys and wherein said tone channel count means detects a tone range for the keys that are depressed in ascertaining the selected property of the tone channels.

4. An electronic musical instrument in which desired musical sound effects, including resonance and/or reverberation effects, are provided to musical notes produced by the instrument, said instrument including a plurality of tone channel means having note-ON states, said instrument comprising:

an output channel through which musical notes are generated by the instrument, said output channel having circuit means for providing musical sound effects to the musical notes;

tone channel count means, for ascertaining a selected property of the tone channels that are simultaneously set to a note-ON state;

parameter value determination means, for determining a parameter value to control said circuit means in consonance with the ascertainment made by said tone channel count means; and control means, for controlling said circuit means in consonance with said parameter value that is determined by said parameter value determination means for providing the desired sound effects for the musical notes.

5. An electronic instrument according to claim 4, wherein said instrument has a keyboard with keys and wherein said tone channel count means counts the number of keys that are depressed in ascertaining the selected property of the tone channels.

6. An electronic musical instrument according to claim 4, wherein said instrument has a keyboard with keys and wherein said tone channel count means detects a tone range for the keys that are depressed in ascertaining the selected properties of the tone channels.

7. An electronic musical instrument in which desired musical sound effects, including resonance and/or reverberation effects, are provided to musical notes produced by the instrument, said instrument including a plurality of tone channel means having note-ON states, said instrument comprising:

an output channel through which musical notes are generated by the instrument, said output channel having circuit means for providing musical sound effects to the musical notes;

tone channel count means, for ascertaining a selected property of the tone channels that are simultaneously set to a note-ON state;

parameter value determination means, for determining a parameter value in consonance with the ascertainment made by said tone channel count means; and effect addition means, for controlling sound effects in consonance with said parameter value that is determined by said parameter value determination means, said effect addition means being coupled to said circuit means for causing said circuit means to provide the desired sound effects for the musical notes.

8. An electronic instrument according to claim 7, wherein said instrument has a keyboard with keys and wherein said tone channel count means counts the number of keys that are depressed in ascertaining the selected property of the tone channels.

9. An electronic musical instrument according to claim 7, wherein said instrument has a keyboard with keys and wherein said tone channel count means detects a tone range for the keys that are depressed in ascertaining the selected property of the tone channels.

10. An electronic musical instrument according to claim 7, wherein said effect addition means is a multiplier.

11. An electronic musical instrument according to claim 7 wherein said effect addition means alters the volume of the musical notes produced by the instrument in consonance with said parameter value and controls the sound effects in accordance with the volume of the musical notes.

* * * * *